US005988627A

United States Patent [19]

Lin et al.

[11] Patent Number: 5,988,627

[45] Date of Patent: Nov. 23, 1999

[54] PAPER-FEEDING APPARATUS

[75] Inventors: Chin-I Lin, Taoyuan Hsien; Wen-Tso Tseng, Taichung; Cheng-Hui Yu, Hualian Hsien, all of Taiwan

[73] Assignee: Umax Data Systems Inc., Hsinchu, Taiwan

[21] Appl. No.: 09/055,233

[22] Filed: Apr. 6, 1998

[51] Int. Cl.[6] ..... B65H 7/08

[52] U.S. Cl. ..... 271/110; 271/118; 271/126; 271/152

[58] Field of Search ..... 271/118, 126, 271/110, 157, 160, 152, 155

[56] References Cited

U.S. PATENT DOCUMENTS 5,351,945 10/1994 Asakawa et al. ..... 271/118
5,386,983 2/1995 Ando ..... 271/118
5,419,543 5/1995 Nakamura et al. .

*Primary Examiner*—David H. Bollinger
*Attorney, Agent, or Firm*—Bacon & Thomas

[57] ABSTRACT

Paper is fed through the printing process of a printing machine by an apparatus which includes a paper-feeding mechanism that is driven by a motor, a paper setting mechanism for handling the sheets of paper being printed, and a paper sensor for detecting whether a sheet is being printed and providing selective control of the motor.

12 Claims, 6 Drawing Sheets

PAPER-FEEDING APPARATUS

BACKGROUND OF THE INVENTION

1. Field of the Invention

This invention relates in general to a paper-feeding apparatus for use on a printing machine, such as a computer printer, a copy machine, a fax machine, and the like, to feed paper sheets through the printing process.

2. Description of Related Art

A conventional paper-feeding apparatus for use on an inkjet printer is disclosed in U.S. Pat. No. 5,419,543 to Nakamura et al., which is illustrated in FIGS. 8–9.

As shown in FIG. 8, the paper-feeding apparatus of U.S. Pat. No. 5,419,543 includes a printer body 1, a paper guiding path 90, a paper setting mechanism 10, a paper feeding mechanism 20, a printing head 3, a paper delivery mechanism 91, and a paper receiving portion 7. Moreover, on the printer body 1, there is provided a drive gear mechanism 50 which uses a motor 51 to drive both the paper setting mechanism 10 and the paper feed mechanism 20. Further, the rotational direction of the motor 51 is controlled by a drive control means 70.

Referring further to FIG. 9, the drive gear mechanism 50 includes a motor 51, a pinion gear 52 axially mounted on the shaft of the motor 51, a first gear portion (including a cam gear 53 and an intermediate gear 54) coupled to a cam member 14 on the paper setting mechanism 10, a second gear portion (including a paper feeding gear 55) meshed to the feed roller 21 on the paper feeding mechanism 20, and a selective power transmission portion 61. Further, the selective power transmission portion 61 includes a sun gear (a power transmission mechanism) 62 meshed to the pinion gear 52; a swing mechanism (a selecting mechanism) 63 axially coupled to the shaft 62*a* of the sun gear 62 and rotatable in the same direction as the sun gear 62; and a planet gear 64 provided on the swing mechanism 63 and meshed to the sun gear 62.

When the motor 51 drives the pinion gear 52 to rotate in the clockwise direction, the sun gear 62 in the selective power transmission portion 61 will be forced to rotate in the counterclockwise direction. This causes the swing mechanism 63 to swing in the counterclockwise direction and the planet gear 64 to be meshed to the intermediate gear 54 in the first gear portion. As a result, the power from the motor 51 is transmitted to the cam member 14, causing the cam member 14 to rotate in the clockwise direction as indicated by the arrow in FIG. 9. At this time, if the cam member 14 is disengaged from the cam-contracted surface 11*c* on the bottom of the paper tray 11, the spring 13 will press upwards against the paper tray 11, causing the paper tray 11 to come into abutment on the feed roller 21, thereby allowing the sheets in the paper tray 11 to be fed in by the feed roller 21. Otherwise, if the cam member 14 is in contact with the cam-contacted surface 11*c*, the cam member 14 will press downwards against the paper tray 11, thereby compressing the spring 13 and causing the paper tray 11 to withdraw from the feed roller 21.

On the other hand, when the motor 51 drives the pinion gear 52 to rotate in the counterclockwise direction (as indicated by the arrow in FIG. 9), it will drive the sun gear 62 to rotate also in the counterclockwise direction, causing the swing mechanism 63 to swing in the clockwise direction. This then causes the planet gear 64 to be meshed to the paper feeding gear 55 in the second gear portion. As a result, the power from the motor 51 is transmitted to the feed roller 21, causing the feed roller 21 to rotate in the clockwise direction. At this time, if the paper tray 11 is in abutment on the feed roller 21, the topmost sheet in the paper tray 11 will be drawn out by the feed roller 21 to be fed into the printing process.

The foregoing paper-feeding apparatus is specifically designed to use just one driving motor to drive the paper setting mechanism and paper feeding mechanism of a printing means. In contrast in more conventional apparatuses two driving motor are used. The use of two driving motors increases the structural complexity of the apparatus, and thus the manufacturing cost. Although the foregoing paper-feeding apparatus can sole this problem, it nonetheless has some other drawbacks. The patented apparatus utilizes two sets of transmission mechanisms, i.e., the drive gear mechanism 50 and the selective power transmission portion 61, which still increases the structural complexity of the apparatus. The high structural complexity increases the manufacturing cost while the resultant apparatus bulky in size. Furthermore, the use of a single-directional clutching mechanism in place of the swing mechanism 63 also increases the structural complexity and thus the manufacturing cost of the apparatus.

SUMMARY OF THE INVENTION

It is therefore an objective of the present invention to provide a paper-feeding apparatus, which can be constructed without using two sets of transmission mechanisms so as to simplify the mechanical structure for more compact size.

It is another an objective of the present invention to provide a paper-feeding apparatus, which can be manufactured with a further reduced manufacturing cost as compared to the prior art.

In accordance with the foregoing and other objectives of the present invention, an improved paper-feeding apparatus is provided. The paper-feeding apparatus is devised for use on a printing machine, such as a computer printer, a copy machine, a fax machine, and the like, to feed paper sheets through the printing process. The paper-feeding apparatus of the invention includes the following constituent parts:

(a) a paper feeding mechanism including an inner sun gear and an outer sun gear; an actuating gear meshed between the inner and outer sun gears; a feed roller axially coupled to the inner sun gear; a deceleration gear meshed to the inner sun gear; wherein the outer sun gear is formed with a toothed portion only on the inner wall thereof, allowing the actuating gear to rotate and not shift when the actuating gear is driven by the inner sun gear and is shifted to beyond either end of the toothed portion of the outer sun gear;

(b) motor means for driving the paper feeding mechanism;

(c) a paper setting mechanism including a paper tray; a support shaft axially coupled to the paper tray; a lifting member pivotally coupled to the support shaft and on which a pile of sheets can be placed; an elastic member for pressing the lifting member to move either upwards or downwards; the elastic member being provided in such a manner that when the lifting member is not pressed by the actuating gear, the elastic member presses against the lifting member to cause the lifting member to come into abutment on the feed roller; and (d) a paper sensor, mounted proximate to the paper-fetching gear set, for detecting whether a sheet is being printed and thereby selectively controlling the motor means to rotate in either direction.

Further, a pinion gear is provided on the shaft of the motor, which is meshed to the deceleration gear, allowing the motor to drive the pinion gear, the deceleration gear, and the inner sun gear. Since the outer sun gear is nonrotatably fixed, the inner sun gear, when driven by the motor to rotate, will cause the actuating gear to shift along the toothed portion of the outer sun gear. Since no teeth are formed on the inner wall of the outer sun gear, the actuating gear will be rotatable but unshiftable within the toothless area. When the motor changes its rotating direction, the actuating gear will be shifted to the other end of the toothed portion of the outer sun gear. When the actuating gear has moved to beyond the end of the toothed portion of the outer sun gear, it will be stopped by a stopper so that it will not be disengaged from the toothed portion of the outer sun gear. When stopped by the stopper, the actuating gear is rotatable but unshiftable.

Further, a revolving arm is axially coupled to between the shaft of the inner sun gear and the shaft of the actuating gear. The revolving arm can be rotated about the shaft of the inner sun gear when the actuating gear is being shifted by the inner sun gear.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

In accordance with the invention, two preferred embodiments are disclosed in the following.

First Preferred Embodiment

Figure 8:
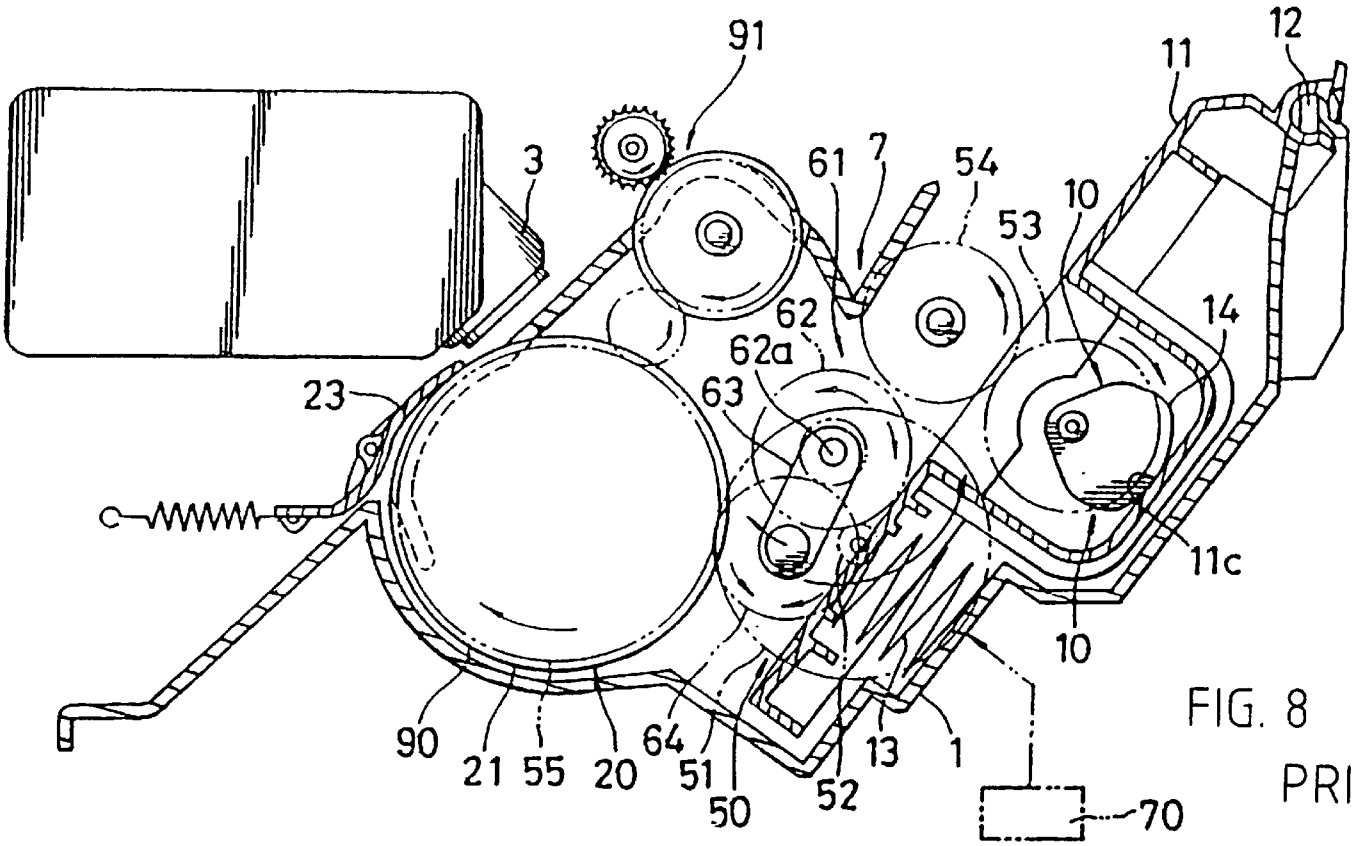
FIG. 8 PRIOR ART
FIG. 8 is a schematic sectional view of a conventional paper-feeding apparatus when the lifting member is withdrawn from the feed roller.
Figure 9:
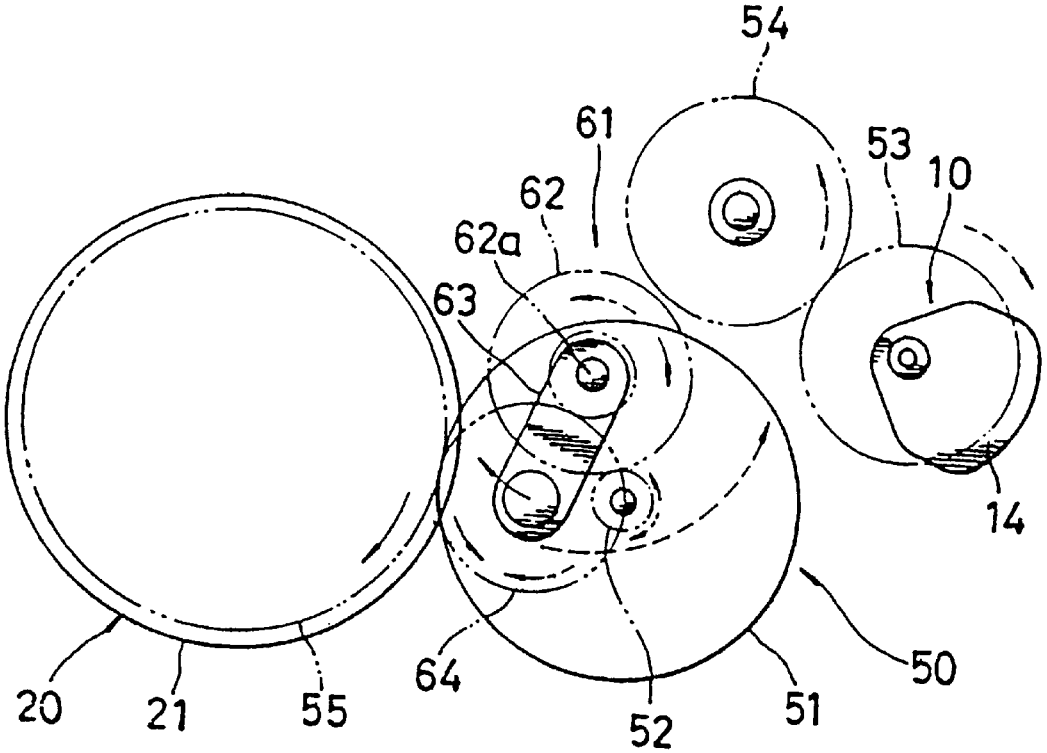
FIG. 9 PRIOR ART
FIG. 9 is a schematic diagram of a drive gear mechanism utilized in the conventional paper-feeding apparatus of FIG. 8.

The first preferred embodiment of the paper-feeding apparatus according to the invention is disclosed in the following with reference to FIGS. 1–5. In these drawings, the constituent parts that are similar in structure and function to those shown in the prior art of FIGS. 8–9 are labeled with the same reference numerals. This embodiment is devised for use, for example, on an inkjet printer.

As shown, the first preferred embodiment of the paper-feeding apparatus according to the invention includes a printer body 1 which is provided with a paper setting mechanism 10, a motor 51, a paper feeding mechanism 20, a paper sensor 4, a printing head 3, a paper delivery mechanism 91, and a paper receiving portion 7.

The paper setting mechanism 10 includes a paper tray 11 having an upright wall 110 attached to the front side of the paper tray 11; a support shaft 12 axially coupled to the paper tray 11; a lifting member 15 pivotally coupled to the support shaft 12 and on which a pile of sheets can be placed; a spring 16 for pressing the lifting member 15 to move either upwards or downwards. The spring 16 has a top end 161 affixed to one lateral side (or the bottom side) of the lifting member 15, and a bottom end 162 affixed to the bottom side of the printer body 1. When the spring 16 is subjected to no external force, the lifting member 15 is abutted on the paper feeding mechanism 20 (see FIG. 1 and FIG. 2).

Figure 1:
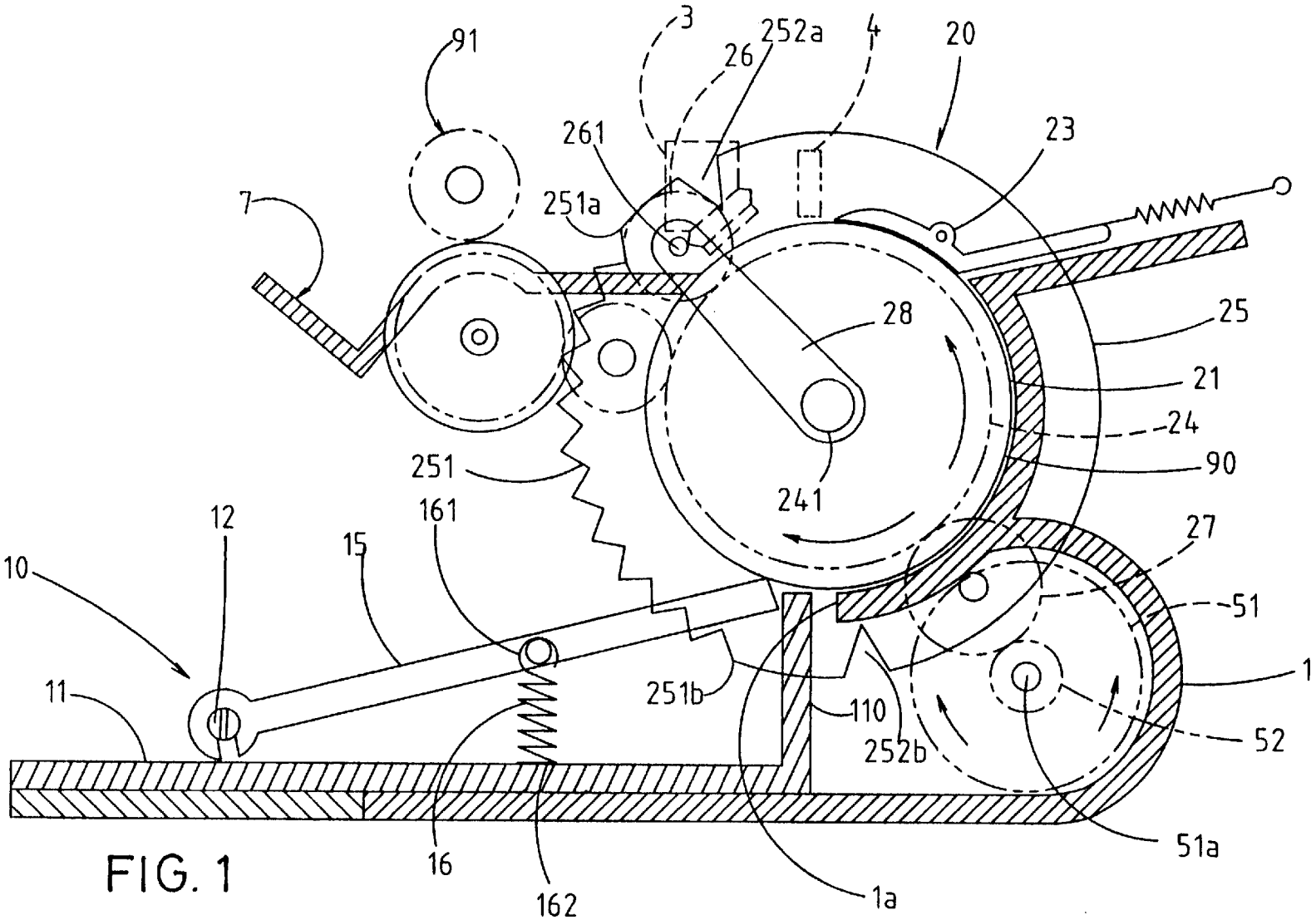
FIG. 1 is a schematic sectional view of a first preferred embodiment of the paper-feeding apparatus according to the invention when the lifting member is abutted on the feed roller.
Figure 2:
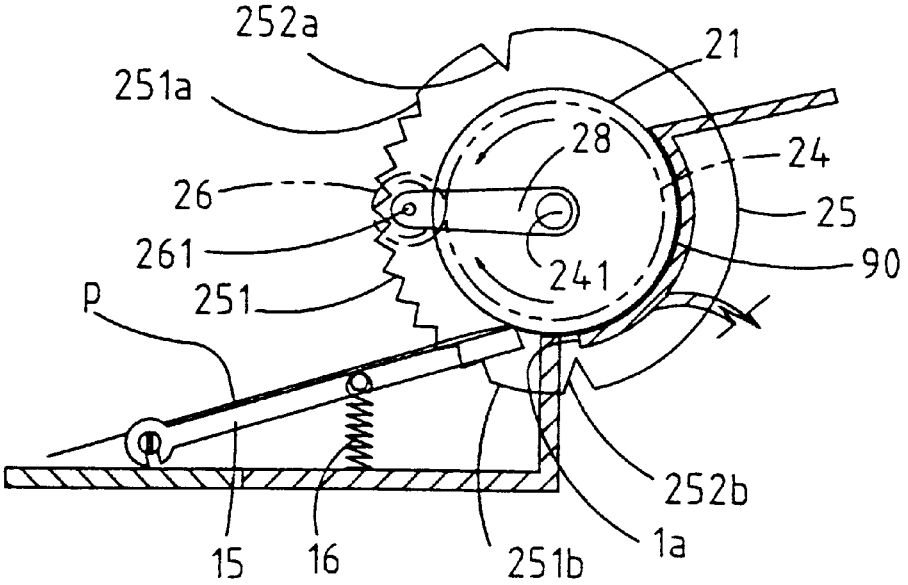
FIG. 2 shows the same of FIG. 1 when the paper-feeding apparatus is fetching a sheet of paper.
Figure 3:
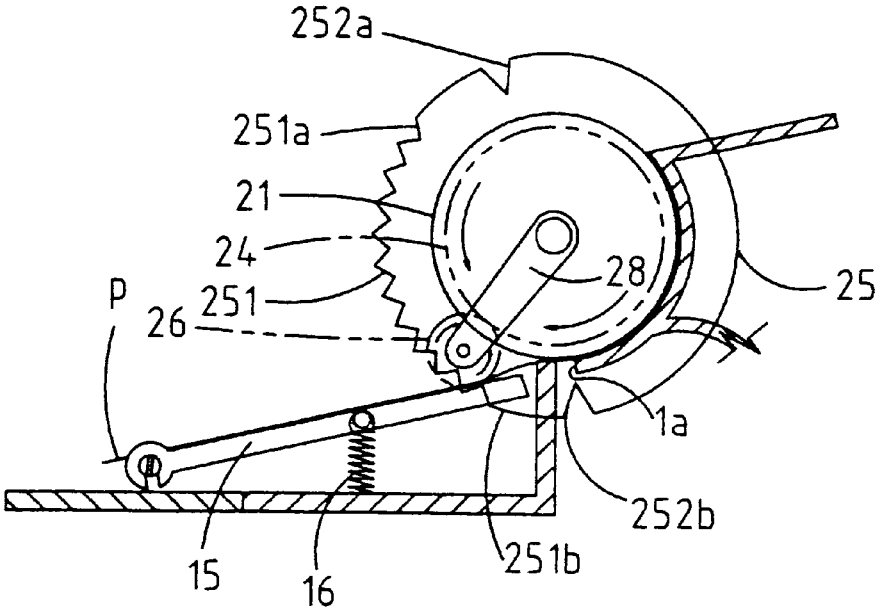
FIG. 3 shows the same of FIG. 1 when the actuating gear presses the lifting member to move downwards.
Figure 4:
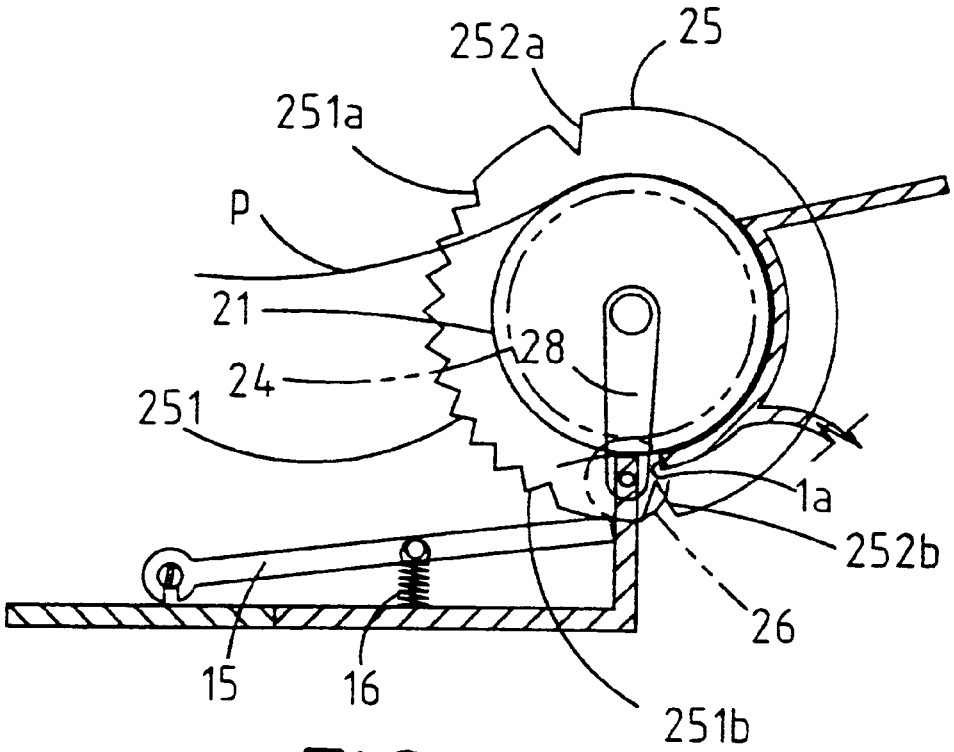
FIG. 4 shows the same of FIG. 1 when delivering the sheet through the printing position.
Figure 5:
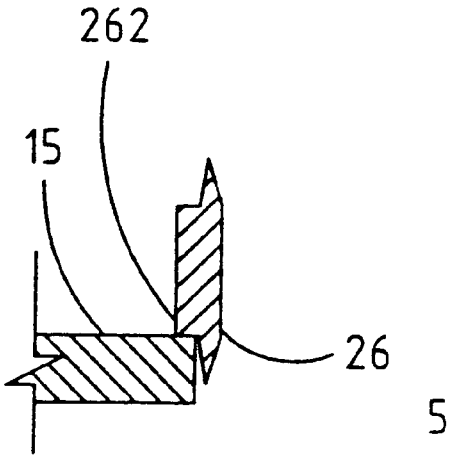
FIG. 5 shows the same of FIG. 1 when the actuating gear is abutted on the lifting member.

As shown in FIG. 1, the paper feeding mechanism 20 includes an inner sun gear 24 and an outer sun gear 25; an actuating gear 26 meshed between the inner and outer sun gears 24, 25; a feed roller 21 axially coupled to the inner sun gear 24; a deceleration gear 27 meshed to the inner sun gear 24; and a revolving arm 28 having one end linked to the gear shaft 241 of the inner sun gear 24 and the other end linked to the gear shaft 261 of the actuating gear 26. The outer sun gear 25 is formed with a toothed portion 251 only on the inner wall thereof, while the top side 251*a* and the bottom side 251*b* of the toothed portion 251 are not formed with any teeth. Further, the outer sun gear 25 is formed with an upper stopper 252*a* and a bottom stopper 252*b* on the inner wall thereof. The deceleration gear 27 is meshed to the pinion gear 52 on the shaft 51*a* of the motor 51. When the motor 51 is rotating in the reverse direction, it will drive the pinion gear 52 to rotate in the counterclockwise direction as indicated by the arrow in FIG. 1, causing the deceleration gear 27 to rotate in the clockwise direction and the inner sun gear 24 to rotate in the counterclockwise direction. As a result, the actuating gear 26 is rotated in the clockwise direction and shifted toward the bottom side 251*b* of the tooth portion 251. As shown in FIG. 5, the actuating gear 26 is formed with a protruded portion 262 on the inner side thereof. When the actuating gear 26 is being shifted downwards, the protruded portion 262 will come into contact with the lifting member 15 and then press against the lifting member 15, causing the lifting member 15 to be pivoted downwards about the support shaft 12 (see FIG. 3). This causes the lifting member 15 to withdraw from the abutment on the feed roller 21 and the spring 16 to be compressed. Once the actuating gear 26 has shifted to beyond the bottom side 251*b* of the toothed portion 251, it will be stopped by the bottom stopper 252*b*. At this time, since the outer sun gear 25 is formed with no toothed portions on its inner wall, the actuating gear 26 will now only be rotatable but unshiftable (see FIG. 4). On the other hand, when the motor 51 is rotated in the position direction, it causes the deceleration gear 27 to rotate in the counterclockwise direction and the inner sun gear 24 to rotate in the clockwise direction. As a result, the actuating gear 26 is rotated in the counterclockwise direction and moved along the toothed portion 251 toward the top side 251*a*. This causes the pressing of the actuating gear 26 on the lifting member 15 to be gradually removed, allowing the compressed spring 16 to restore shape and thus press against and move the lifting member 15 upwards. Until the actuating gear 26 is completely separated from the lifting member 15, the spring 16 will then press the lifting member 15 to come into abutment on the feed roller 21. When the actuating gear 26 has moved to beyond the top side 251*a* of the toothed portion 251, it will be stopped by the upper stopper 252*a*. At this time, the outer sun gear 25 is formed with no toothed portions on its inner wall, the actuating gear 26 will now be rotatable but unshiftable (see FIG. 1).

Furthermore, a pressing member 23 is provided near the top of the feed roller 21 for pressing the feed-in sheet firmly on the feed roller 21 so that the sheet can be secured in position when it is being fed through the feed roller 21. The paper sensor 4 is mounted between the pressing member 23 and the printing head 3 for detecting whether a sheet is being fed into the paper feeding mechanism 20. During the feeding process, the paper sensor 4 will be silent; however, when paper sensor 4 detects that the tail end of the sheet has passed thereby, it will issue a trigger signal after a preset time period. In response to this trigger signal, the motor 51 will change its rotating direction so as to allow the paper-feeding apparatus to fetch the next sheet.

As shown in FIG. 1, in operation of this embodiment, the first step is to activate the paper sensor 4 to issue a trigger signal to the motor 51 to cause the motor 51 to rotate in the reverse direction. This then causes the inner sun gear 24 to rotate in the counterclockwise direction and the actuating gear 26 to rotate in the clockwise direction, causing the actuating gear 26 to be shifted toward the bottom side 251*b* of the toothed portion 251. As a result of this, the feed roller 21 is driven by the inner sun gear 24 to rotate in the counterclockwise direction, thereby dragging the topmost sheet on the lifting member 15 into the paper guiding path 90 between the printer body 1 and the paper guiding path 90 (see FIG. 2). Subsequently, when the actuating gear 26 is driven by the inner sun gear 24 to come into abutment on the lifting member 15, the protruded portion 262 thereof will press against the lifting member 15, thereby causing the lifting member 15 to be moved downwards and thus separated from the feed roller 21 (see FIG. 3). Meanwhile, the spring 16 is compressed. This can prevent the next sheet from being dragged into the paper feeding mechanism 20 at the same time when the current sheet is being fed in by the feed roller 21. When the actuating gear 26 has shifted to beyond the bottom side 251*b* of the toothed portion 251, it will be stopped by the bottom stopper 252*b*. At this time, since no teeth are formed between the bottom side 251*b* of the toothed portion 251 and the bottom stopper 252*b*, the actuating gear 26 will be rotatable but unshiftable within this toothless area. The lifting member 15 is driven by the actuating gear 26 to the lowest position (see FIG. 4). The motor 51 continues to drive the feed roller 21 to rotate continuously, thereby dragging the sheet P to move along the paper guiding path 90 to pass the bottom of the printing head 3 to be printed. When the paper sensor 4 detects that the tail end of the sheet P has passed thereby, it will generate a trigger signal after a preset time period. This trigger signal commands the motor 51 to rotate in the positive direction so as to drive the spring 16 to move toward the top side 251*a* of the toothed portion 251, thereby gradually removing the pressing force on the lifting member 15, allowing the compressed spring 16 to restore shape and thus press the lifting member 15 to move upwards. Until the actuating gear 26 is completely separated from the lifting member 15, the lifting member 15 will be pressed by the spring 16 to come into abutment on the feed roller 21. When the actuating gear 26 has moved beyond the top side 251*a* of the toothed portion 251, it will be stopped by the upper stopper 252*a*. At this time, since the outer sun gear 25 is formed with no toothed portions on its inner wall, the actuating gear 26 will now be rotatable but unshiftable (see FIG. 1). When the actuating gear 26 is restored in position to the top side 251*a* and the lifting member 15 is abutted on the feed roller 21, the paper-feeding apparatus is returned to the ready state to fetch the next sheet. When the motor 51 is rotated in the reverse direction, the next sheet will be dragged into the printing position to repeat the forgoing printing process again on the next sheet.

On the other hand, if the paper sensor 4 detects that no sheet is being fed in by the feed roller 21 into the paper guiding path 90, it will then command the motor 51 to rotate in the reverse direction so as to drive the lifting member 15 back to the ready position, and after this, the paper sensor 4 will command the motor 51 to rotate in the reverse direction so as to cause the feed roller 21 to drag the sheet into the paper guiding path 90.

Second Preferred Embodiment

Figure 6:
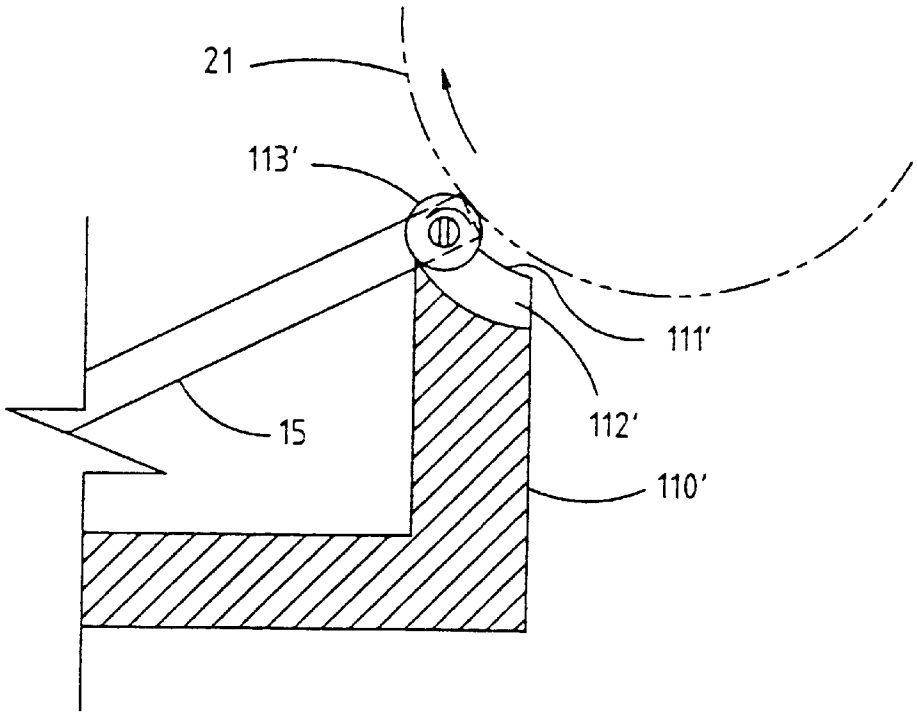
FIG. 6 is a schematic sectional view of a second preferred embodiment of the paper-feeding apparatus according to the invention when the lifting member is separated from the feed roller.
Figure 7:
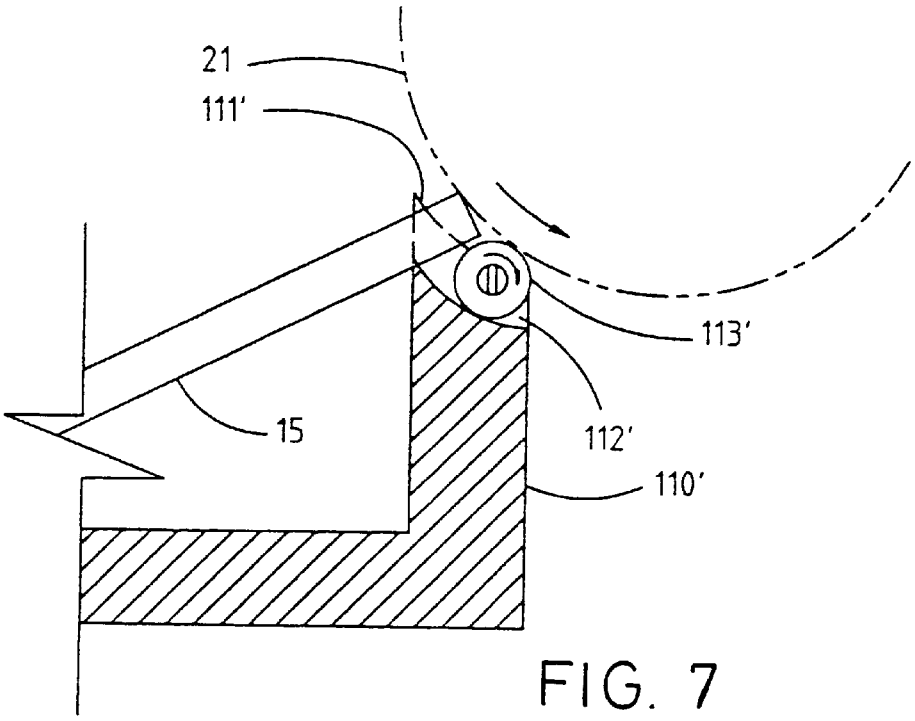
FIG. 7 shows the same of FIG. 6 when the lifting member is abutted on the feed roller.

The second preferred embodiment of the paper-feeding apparatus according to the invention is disclosed in the following with reference to FIGS. 6–7. In these drawings, the constituent parts that are similar in structure and function to those shown in the previous embodiment of FIGS. 1–5 are labeled with the same reference numerals.

This embodiment differs from the previous ones particularly in that this embodiment further includes a curved top side 111' formed on the top of the upright wall 110'; at least one guide slot 112' formed in the curved top side 111'; and a roller 113' which is slidably mounted in the guide slot 112' and can come into abutment on the feed roller 21. The curvature of the curved top side 111' is matched to the circumference of the feed roller 21. With these additional provisions, the feed roller 21, when rotating in the clockwise direction, will drive the roller 113' to rotate in the counterclockwise direction and move to the top side of the curved top side 111' of the upright wall 110' (see FIG. 6). On the other hand, when the feed roller 21 is rotating in the counterclockwise direction, it will drive the roller 113' to rotate in the clockwise direction and move to the bottom side of the curved top side 111' of the upright wall 110' (see FIG. 7). Therefore, when the paper-feeding apparatus is restored to the ready state to fetch the next sheet, the feed roller 21 is rotated in the clockwise direction, causing the roller 113' to rotate in the counterclockwise direction, thereby preventing the sheet P from being fed between the feed roller 21 and the roller 113'. When the feed roller 21 is rotated in the counterclockwise direction, causing the roller 113' to rotate in the clockwise direction, it can help the feeding of the sheet to proceed smoothly without rumpling the sheet.

Moreover, the assembly of the guide slot 112' and the roller 113' can be mounted on the top side of the paper feeding portion 1*a* located beneath the feed roller 21 in the printer body 1.

When the sheet has undergone the printing process through the bottom of the printing head 3, it is drawn out of the paper guiding path 90 by the paper delivery mechanism 91 and then delivered to the paper receiving portion 7. This mechanism is the same as the prior art so description thereof will not be further detailed.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

What is claimed is:

1. A paper-feeding apparatus, which comprises:

a paper feeding mechanism including an inner sun gear and an outer sun gear; an actuating gear meshed between said inner and outer sun gears, the actuating gear being driven by the inner sun gear; a feed roller axially coupled to said inner sun gear; a deceleration gear meshed to said inner sun gear, wherein said outer sun gear is formed with a toothed portion only on an inner wall thereof, the toothed portion having a top side and a bottom side for causing said actuating gear to rotate and be shifted to beyond either said top or bottom side of the toothed portion of said outer sun gear during rotation of the inner sun gear in a clockwise or a counterclockwise direction;

motor means for driving said paper feeding mechanism, the motor means having a shaft rotatable in both forward and reverse directions for rotating the inner sun gear in said clockwise and counterclockwise directions, respectively;

a paper setting mechanism coupled to said paper feeding mechanism and including a paper tray; a support shaft axially coupled to said paper tray; a lifting member pivotally coupled to said support shaft and on which a pile of sheets can be placed; an elastic member for pressing said lifting member to move either upwards or downwards; said elastic member being such that when said lifting member is not pressed by said actuating gear, said elastic member presses against the lifting member to cause said lifting member to come into abutment with said feed roller; and a paper sensor, mounted proximate to said paper feed mechanism, for detecting whether a sheet is being fed to a predetermined position and thereby selectively control said shaft of said motor means to rotate in either said forward or reverse direction.

2. The paper-feeding apparatus of claim 1, wherein said outer sun gear is formed with an upper stopper and a bottom stopper on the inner wall thereof for stopping said actuating gear from moving beyond either end of the toothed portion of said outer sun gear when said actuating gear is being driven by said inner sun gear.

3. The paper-feeding apparatus of claim 2, wherein a first toothless area is provided between said upper stopper and one end of the toothed portion of said outer sun gear and a second toothless area between said bottom stopper and the other end of the toothed portion of said outer sun gear, allowing said actuating gear to be rotatable but unshiftable when moved to within said first and second toothless areas.

4. The paper-feeding apparatus of claim 1, wherein said deceleration gear is meshed to a pinion gear on the shaft of said motor means, allowing said motor means to transmit power via said deceleration gear to said paper feeding mechanism.

5. The paper-feeding apparatus of claim 1, wherein said elastic member is a spring.

6. The paper-feeding apparatus of claim 1, wherein said elastic member is an elastic cylindrical member.

7. The paper-feeding apparatus of claim 1, wherein said actuating gear is formed with a protruded portion on the inner side thereof, said protruded portion pressing against said lifting member when said actuating gear is being rotated.

8. The paper-feeding apparatus of claim 1, wherein said paper tray is formed with an upright wall having a curved top side formed with at least one guide slot for a roller to be slidably mounted therein and come into abutment on a feed roller in said paper feeding mechanism; wherein when the paper-feeding apparatus is restored to a ready state to fetch a next sheet, said feed roller is being rotated in the clockwise direction and causes said roller to rotate in the counterclockwise direction, thereby preventing the sheet from being fed between said feed roller and said roller; and when said feed roller is being rotated in the counterclockwise direction causing said roller to rotate in the clockwise direction, the fed-in sheet is prevented from being rumpled.

9. The paper-feeding apparatus of claim 1, wherein said paper feeding mechanism is mounted on a casing, with a paper guiding path formed between said casing and said feed roller.

10. The paper-feeding apparatus of claim 9, wherein said casing is formed with a guide slot beneath said feed roller for a roller to be slidably mounted therein; wherein when said feed roller is being rotated in the clockwise direction causing said roller to rotate in the counterclockwise direction, the sheet is prevented from being fed between said feed roller and said roller; and when said feed roller is being rotated in the counterclockwise direction causing said roller to rotate in the clockwise direction, the fed-in sheet is prevented from being rumpled between said roller and said feed roller.

11. The paper-feeding apparatus of claim 1, wherein said paper sensor is a proximity sensor for detecting whether a sheet exists in the printing position.

12. The paper-feeding apparatus of claim 1, further comprising a revolving arm provided between said inner sun gear and said actuating gear.

* * * * *